US006093528A

United States Patent [19]

Terrell et al.

[11] Patent Number: 6,093,528

[45] Date of Patent: Jul. 25, 2000

[54] REDUCING AGENTS FOR USE IN THERMOGRAPHIC RECORDING MATERIALS

[75] Inventors: David Terrell, Lint; Johan Loccufier, Zwijnaarde; Geert Defieuw, Bonheiden; Ivan Hoogmartens, Wilrijk, all of Belgium

[73] Assignee: Agfa-Gevaert, Mortsel, Belgium

[21] Appl. No.: 09/140,949

[22] Filed: Aug. 27, 1998

Related U.S. Application Data

[60] Provisional application No. 60/069,214, Dec. 11, 1997.

[30] Foreign Application Priority Data

Sep. 17, 1997 [EP] European Pat. Off. ..... 97202872

[51] Int. Cl.[7] ..... G03C 1/498

[52] U.S. Cl. ..... 430/617; 430/620

[58] Field of Search ..... 430/617, 619, 430/485, 935, 620

[56] References Cited

FOREIGN PATENT DOCUMENTS 0248405 of 0000 European Pat. Off. .
0599580 of 0000 European Pat. Off. .

*Primary Examiner*—Thorl Chea
*Attorney, Agent, or Firm*—Baker Botts L.L.P.

[57] ABSTRACT

A substantially light-insensitive black and white monosheet thermographic recording material is provided comprising a support and a thermosensitive element containing a substantially light-insensitive organic silver salt, a 1,2-dihydroxyphenyl-compound in thermal working relationship therewith and a binder, wherein the 1,2-dihydroxyphenyl-compound is represented by formula (I):

(I)

where R is —P(═O)$R^1R^2$, —$SO_xR^3$, —CN, —$NO_2$ or —$CR^4$═$NR^5$ when n is 0; R is —P(═O)$R^1R^2$, —$SO_xR^3$, —CN, —$NO_2$, —$CR^4$═$NR^5$ or —$COR^6$ when n is an integer; $R^1$ and $R^2$ are independently an alkyl, an aryl, an alkoxy, an aryloxy, a hydroxy or an amino group; $R^3$ is an alkyl, an aryl or an amino group; $R^4$ is an alkyl or an aryl group or hydrogen; $R^5$ is an alkyl, an aryl, a hydroxy, an alkoxy, an aryloxy, an acyl or an amino amino group; $R^6$ is an alkyl, an aryl, an alkoxy, an aryloxy, a hydroxy or an amino group or hydrogen; x is 1, 2 or 3; and the benzene ring of the 1,2-dihydroxyphenyl-compound represented by the formula (I) may be further substituted.

16 Claims, No Drawings

REDUCING AGENTS FOR USE IN THERMOGRAPHIC RECORDING MATERIALS

The application claims the benefit of U.S. Provisional Application No. 60/069,214 filed Dec. 11, 1997.

FIELD OF THE INVENTION

The present invention relates to black and white substantially light-insensitive thermographic recording materials comprising a thermosensitive element containing a substantially light-insensitive organic silver salt and a novel reducing agent.

BACKGROUND OF THE INVENTION

Thermal imaging or thermography is a recording process wherein images are generated by the use of thermal energy. In thermography three approaches are known:

1. Direct thermal formation of a visible image pattern by image-wise heating of a recording material containing matter that by chemical or physical process changes colour or optical density.
2. Image-wise transfer of an ingredient necessary for the chemical or physical process bringing about changes in colour or optical density to a receptor element.
3. Thermal dye transfer printing wherein a visible image pastern is formed by transfer of a coloured species from an image-wise heated donor element onto a receptor element.

Most of the "direct" thermographic recording materials are of the chemical type. On heating to a certain conversion temperature, an irreversible chemical reaction takes place and a coloured image is produced. According to U.S. Pat. No. 3,080,254 a typical heat-sensitive copy paper includes in the heat-sensitive layer a thermoplastic binder, e.g ethyl cellulose, a water-insoluble silver salt, e.g. silver stearate and an appropriate organic reducing agent, of which 4-methoxy-1-hydroxy-dihydronaphthalene is a representative.

EP-A 248 405 discloses a thermal recording material with a colour-developing layer, which contains an electron acceptor and an electron donor in addition to the usual additives, characterized in that the electron acceptor is a metallic double salt of a long-chain fatty acid with 16 to 35 carbon atoms.

EP-A 599 580 discloses a thermal recording sheet comprising, in order: (a) a substrate; (b) an intermediate layer which comprises a pigment having an oil absorption according to Japanese Industrial Standard (JIS) K501 of 100 mL/100 g or less; and (c) a thermal color developing layer which comprises a leuco dye type chromogenic component consisting of a leuco dye and an organic color developer and a metal chelate type chromogenic component consisting of an electron acceptor and an electron donor, wherein: the organic color developer is at least one of compounds of formula (I) and formula (II):

(I)

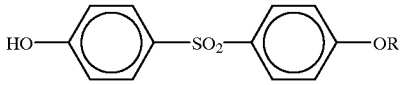

wherein R is propyl, isopropyl, or butyl;

(II)

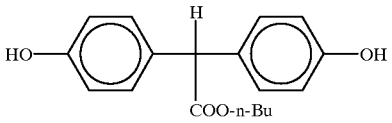

the electron acceptor is a metal double salt of a fatty acid having 16 to 35 carbon atoms; and the electron donor is a polyhydric aromatic compound of formula (III):

(III)

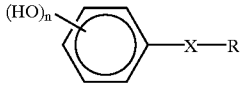

wherein R is a $C_{18}$- to $C_{35}$-alkyl group,

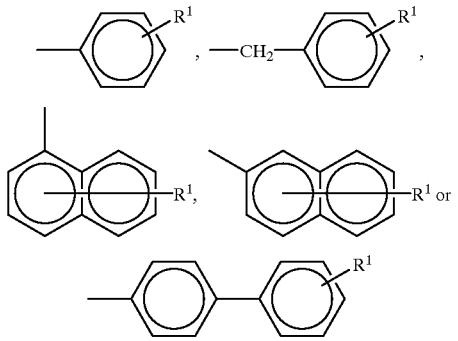

wherein $R_1$ is a $C_{18}$- to $C_{35}$-alkyl group, n is an integer of 2 or 3, —X— is —$CH_2$—, —$CO_2$—, —CO—, —O—, —CONH—, —CO(R')N— (wherein R' is a $C_{18}$- to $C_{35}$-group), —$SO_2$—, —$SO_3$— or —$SO_2$NH—.

U.S. Pat. No. 5,582,953 discloses a direct recording process wherein a direct thermal recording material is heated dot-wise and the direct thermal recording material comprises on a substrate an imaging layer, the imaging layer containing uniformly distributed in a film-forming polymeric binder (i) one or more substantially light-insensitive organic silver salts being no double salts, the silver salt(s) being in thermal working relationship with (ii) an organic reducing agent therefor, wherein the reducing agent is a benzene compound the benzene nucleus of which is substituted with a substituent linked to the benzene nucleus by means of a carbonyl group, wherein the carbonyl group is linked to the benzene nucleus at a position which is designated the 1-position of the benzene nucleus, wherein the benzene nucleus is further substituted in a 3-position relative to the 1-position with a single hydroxy group and in a 4-position relative to the 1-position with a single hydroxy group, wherein the reducing agent is selected from the group consisting of an alkyl or aryl ester of 3,4-dihydroxybenzoic acid, 3,4-dihydroxybenzaldehyde, 3,4-dihydroxy-benzamide and an alkyl or aryl (3,4-dihydroxyphenyl)ketone.

However, prints produced with direct thermal recording materials using reducing agents according to the teaching of U.S. Pat. No. 5,582,953 exhibit unsatisfactory archivability, insufficient light stability over the whole sensitometric range and unsatisfactory colour neutrality. There is therefore a need for direct thermal recording materials produced by coating from solvent or aqueous media, whose prints exhibit improved archivability, improved light stability over the whole sensitometric range and improved colour neutrality.

OBJECTS OF THE INVENTION

It is therefore an object of the present invention to provide thermographic recording materials whose prints have high $D_{max}$ and low $D_{min}$ levels and exhibit improved archivability and/or improved light stability and/or improved colour neutrality over the whole range of print densities.

Further objects and advantages of the invention will become apparent from the description hereinafter.

SUMMARY OF THE INVENTION

Surprisingly it has been found that prints of thermographic recording materials coated from both aqueous and solvent media containing novel 3,4-dihydroxyphenyl compounds exhibit substantially improved archivability over the whole density range, substantially improved light stability and improved colour neutrality over prints made with thermographic recording materials containing a reducing agent according to the teaching of U.S. Pat. No. 5,582,953.

A substantially light-insensitive black and white monosheet thermographic recording material is provided according to the present invention comprising a support and a thermosensitive element containing a substantially light-insensitive organic silver salt, a 1,2-dihydroxyphenyl-compound in thermal working relationship therewith and a binder, wherein the 1,2-dihydroxyphenyl-compound is represented by formula (I):

(I)

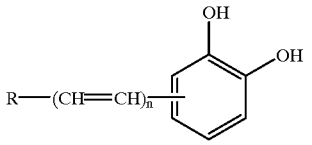

where R is —P(=O)$R^1R^2$, —$SO_xR^3$, —CN, —$NO_2$ or —$CR^4$=$NR^5$ when n is 0; R is —P(=O)$R^1R^2$, —$SO_xR^3$, —CN, —$NO_2$, —$CR^4$=$NR^5$ or —$COR^6$ when n is an integer; $R^1$ and $R^2$ are independently an alkyl, an aryl, an alkoxy, an aryloxy, a hydroxy or an amino group; $R^3$ is an alkyl, an aryl or an amino group; $R^4$ is an alkyl or an aryl group or hydrogen; $R^5$ is an alkyl, an aryl, a hydroxy, an alkoxy, an aryloxy, an acyl or an amino amino group; $R^6$ is an alkyl, an aryl, an alkoxy, an aryloxy, a hydroxy or an amino group or hydrogen; x is 1, 2 or 3; and the benzene ring of the 1,2-dihydroxyphenyl-compound represented by the formula (I) may be further substituted. Substituted amino groups can also constitute a heterocyclic ring system, which itself may be substituted.

A process for producing a substantially light-insensitive black and white monosheet thermographic recording material, as described above, is also provided by the present invention comprising the steps of: producing one or more aqueous coating compositions containing together the substantially light-insensitive organic silver salt, the reducing agent and the binder; and applying the one or more aqueous coating compositions to the same side of the support as the subbing layer thereby forming after drying the thermosensitive element.

Preferred embodiments of the present invention are disclosed in the detailed description of the invention.

DETAILED DESCRIPTION OF THE INVENTION

Aqueous

The term aqueous for the purposes of the present invention includes mixtures of water with water-miscible organic solvents such as alcohols e.g. methanol, ethanol, 2-propanol, butanol, iso-amyl alcohol etc; glycols e.g. ethylene glycol; glycerine; N-methyl pyrrolidone; methoxypropanol; and ketones e.g. 2-propanone and 2-butanone etc.

Substantially

By substantially light-insensitive is meant not intentionally light sensitive. By substantially solvent-free aqueous medium is meant that solvent, if present, is present in amounts below 10% by volume of the aqueous medium.

1,2-dihydroxyphenyl-compounds

The organic reducing agent used in the present invention is a 1,2-dihydroxyphenyl-compound represented by formula (I). When formula (I) represents an acid, salts of the acid are also included under formula (I). The substituents represented by $R^1$, $R^2$, $R^3$, $R^4$, $R^5$ and $R^6$ may be further substituted. Substituted amino groups can also constitute a heterocyclic ring system, which itself may be substituted. Preferred substituents of the benzene ring of the 1,2-dihydroxyphenyl-compound represented by formula (I) are halogen atoms, aryl groups, alkyl groups, the atoms necessary to form an annulated carbocyclic or heterocyclic ring, which may itself be substituted, and the atoms necessary to form an annulated ring system together with the R—$(CH{=}CH)_x$— substituent, which itself may be substituted.

Preferred R—$(CH{=}CH)_x$— substituents for the 1,2-dihydroxyphenyl-compounds according to formula (I) are: tetra-alkyl phosphonium, arylalkylphosphonium, tetraaryl phosphonium, dialkyl phosphonato-, arylalkylphosphonato-, alkyl sulfinate, aralkyl sulfinate, aryl sulfinate, alkaryl sulfinate, alkyl-sulfonamido, aralkylsulfonamido, arylsulonamido, alkarylsulfon-amido, alkyl sulfonate, aralkyl sulfonate, aryl sulfonate, alkaryl sulfonate, alkyl sulfinatovinyl, aralkyl sulfinatovinyl, aryl sulfinatovinyl, alkaryl sulfinatovinyl, alkyl-sulfonamidovinyl, aralkylsulfonamidovinyl, arylsulonamidovinyl, alkarylsulfonamido-vinyl, alkyl sulfonatovinyl, aralkyl sulfonatovinyl, aryl sulfonatovinyl, alkaryl sulfonatovinyl, cyano, cyanovinyl, nitro, and nitrovinyl groups, which may also be substituted.

Preferred reducing agents for use in the present invention are selected from the group consisting of: consisting of: aryl(3,4-dihydroxyphenyl)sulfinates, alkyl(3,4-dihydroxyphenyl)sulfinates, 3,4-dihydroxyphenyl-alkylsulfones, 3,4-dihydroxyphenyl-arylsulfones, aryl(3,4-dihydroxyphenyl)sulfonates, alkyl(3,4-dihydroxyphenyl) sulfonates and 3,4-dihydroxybenzonitrile compounds.

Particularly preferred reducing agents for use in the present invention are represented by the formulae:

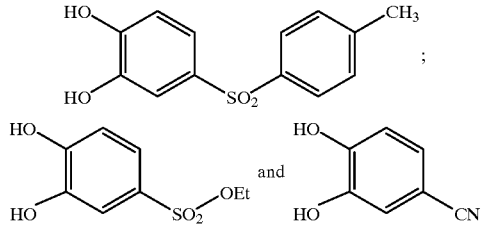

Suitable 1,2-dihydroxyphenyl-compounds for use according to the present invention are:

R01
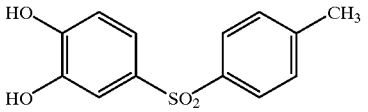
R02
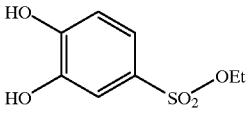
R03
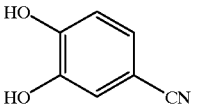
R04
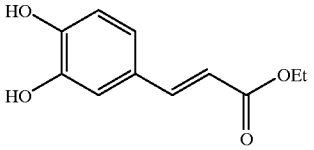
R05
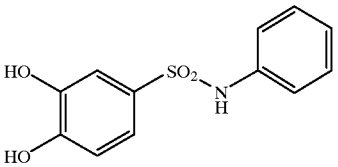
R06
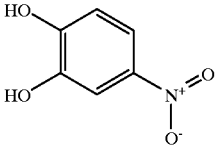
R07
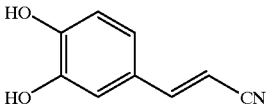
R08
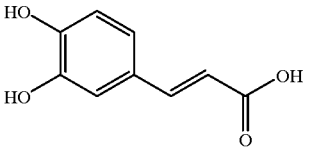
R09
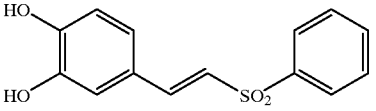
R10
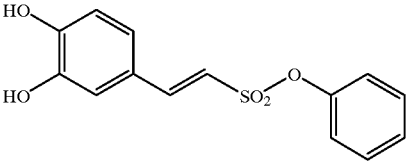
-continued
R11
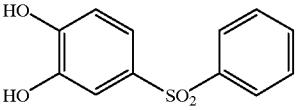
R12
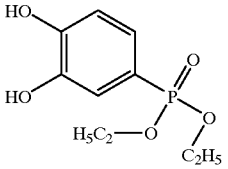
R13
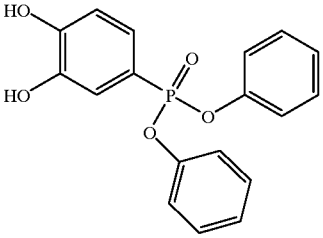
R14
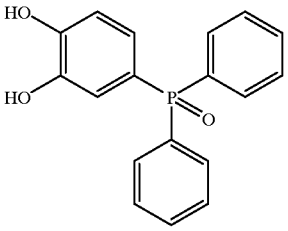
R15
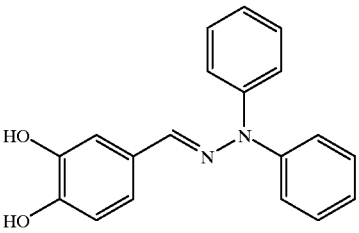
R16
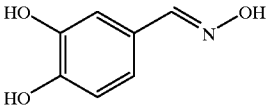
R17
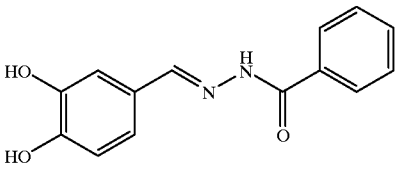
R18
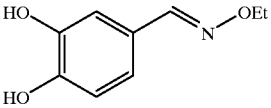
R19
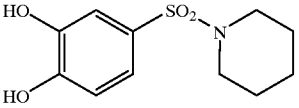

-continued

R20

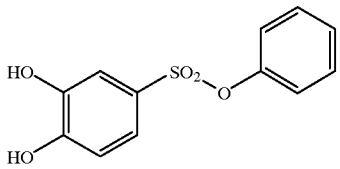

R21

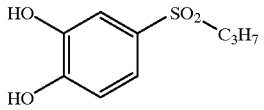

R22

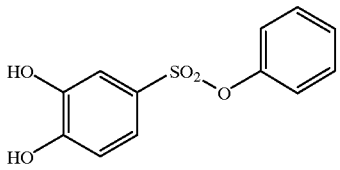

R23

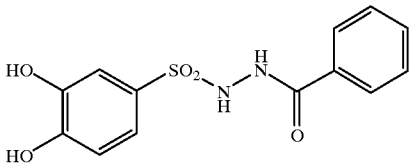

R24

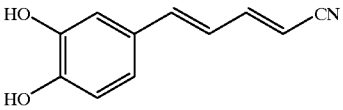

R25

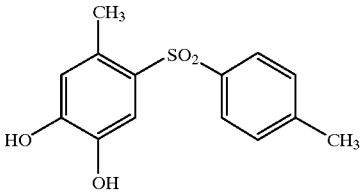

R26

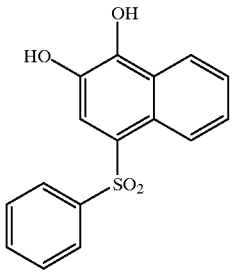

R27

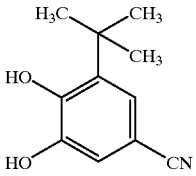

-continued

R28

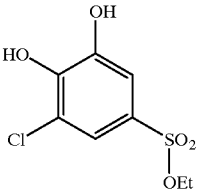

R29

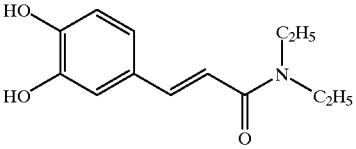

R30

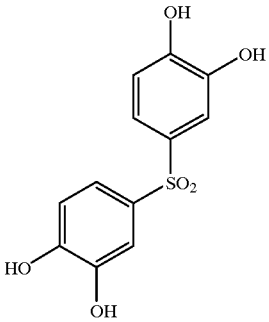

R31

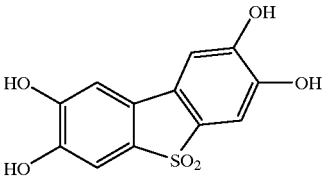

Thermosensitive Element

According to the present invention, a thermographic recording material is provided comprising a thermosensitive element including a substantially light-insensitive organic silver salt, an organic reducing agent therefor in thermal working relationship therewith and a binder. The thermosensitive element may comprise a layer system in which the ingredients may be dispersed in different layers, with the proviso that the substantially light-insensitive organic silver salt and the 1,2-dihydroxyphenyl-compound are in thermal working relationship with one another i.e. during the thermal development process the 1,2-dihydroxyphenyl-compound must be present in such a way that it is able to diffuse to the substantially light-insensitive organic silver salt particles so that reduction of the substantially light-insensitive organic silver salt can take place.

Organic Silver Salts

Preferred substantially light-insensitive organic silver salts for use in the thermographic recording materials, according to the present invention, are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Silver salts of modified aliphatic carboxylic acids with thioether group as described e.g. in GB-P 1,111,492 and other organic silver salts as described in GB-P 1,439,478, e.g. silver benzoate, may likewise be used to produce a thermally developable silver image. Combinations of different organic silver salts may also be used in the thermographic recording materials of the present invention. A preferred process for producing a suspension of particles containing a substantially light-insensitive organic silver salt is disclosed in EP-A 754 969.

Auxiliary Reducing Agents

The reducing agents used in accordance with the present invention being considered as primary or main reducing agents may be used in conjunction with so-called auxiliary reducing agents. Such auxiliary reducing agents are e.g. hydroquinone or catezhol substituted with strongly electron-withdrawing groups such as sulfonic acid groups; sterically hindered phenols, such as describe in U.S. Pat. No. 4,001,026; bisphenols, e.g. of the type described in U.S. Pat. No. 3,547,648; sulfonamidophenols, such as described in Research Disclosure, February 1979, item 17842, in U.S. Pat. Nos. 4,360,581 and 4,782,004, and in EP-A 423 891; hydrazides such as disclosed in EP-A 762 196, sulfonyl hydrazide reducing agents such as disclosed in U.S. Pat. No. 5,464,738; trityl hydrazides and fornyl-phenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5.545.507 and U.S. Pat. No. 5,558,983; acrylonitrile compounds as disclosed in U.S. Pat. No. 5,545,515 and U.S. Pat. No. 5,635,339; 2-substituted malondialdehyde compounds such as d is closed in U.S. Pat. No. 5,654,130; and organic reducing metal salts, e.g. stannous stearate described in U.S. Pat. Nos. 3,460,946 and 3,547,648. The auxiliary reducing agents may be present in the imaging layer or in a polymeric binder layer in thermal working relationship thereto.

In a preferred embodiment of the present invention the thermographic recording material comprises a support and a thermosensitive element which further contains a catechol compound substituted with a strongly electron-withdrawing group.

Binder

The thermosensitive element of the thermographic recording materials of the present invention may be coated onto a support in sheet- or web-form from an organic solvent containing the binder dissolved therein or may be applied from an aqueous medium using water-soluble or water-dispersible binders.

Suitable binders for coating from an organic solvent are all kinds of natural, modified natural or synthetic resins or mixtures of such resins, wherein the organic heavy metal salt can be dispersed homogeneously: e.g. cellulose derivatives, cellulose esters, carboxymethylcellulose, starch ethers, galactomannan, polyurethanes, polycarbonates, polyesters, polymers derived from α,β-ethylenically unsaturated compounds such as after-chlorinated polyvinyl chloride, partially hydrolyzed polyvinyl acetate, polyvinyl alcohol, polyvinyl acetals, preferably polyvinyl butyral, and homopolymers and copolymers produced using monomers selected from the group consisting of: vinyl chloride, vinylidene chloride, vinyl esters, acrylonitrile, acrylamides, methacrylamides. methacrylates, acrylates, methacrylic acid, acrylic acid, vinyl esters, styrenes, dienes and alkenes; or mixtures thereof.

Suitable water-soluble film-forming binders are: polyvinyl alcohol, polyacrylamide, polymethacrylamide, polyacrylic acid, polymethacrylic acid, polyethyleneglycol, polyvinylpyrrolidone, proteinaceous binders such as gelatine modified gelatines such as phthaloyl gelatine, polysaccharides, such as starch, gum arabic and dextran and water-soluble cellulose derivatives.

Suitable water-dispersible binders are any water-insoluble polymer. It should be noted that there is no clear cut transition between a polymer dispersion and a polymer solution in the case of very small polymer particles resulting in the smallest particles of the polymer being dissolved and those slightly larger being in dispersion.

Preferred water-dispersible binders for use according to the present invention are water-dispersible film-forming polymers with convalently bonded ionic groups selected from the group consisting of sulfonate, sulfinate, carboxylate, phosphate, quaternary ammonium, tertiary sulfonium and quaternary phosphonium groups. Further preferred water-dispersible binders for use according the the present invention are water-dispersible film-forming polymers with convalently bonded moieties with one or more acid groups. Water-dispersible binders with crosslinkable groups, e.g. epoxy groups, aceto-acetoxy groups and crosslinkable double bonds are also preferred. Further preferred water-dispersible binders for use in the present invention are polymer latexes. Compositions of polymer latexes suitable for use in the present invention are given in the table below:

| polymer latex nr. | B [% by wt.] | IP [% by wt.] | BA [% by wt.] | S [% by wt.] | MMA [% by wt.] | IA [% by wt.] | MAA [% by wt.] | AA [% by wt.] |
|---|---|---|---|---|---|---|---|---|
| 1 | 47.5 | — | — | — | 47.5 | 5 | — | — |
| 2 | 45 | — | — | — | 45 | 10 | — | — |
| 3 | 49 | — | — | — | 49 | 2 | — | — |
| 4 | — | 47.5 | — | — | 47.5 | 5 | — | — |
| 5 | — | — | 43 | 55 | — | 2 | — | — |
| 6 | — | — | 43 | 55 | — | — | 2 | — |
| 7 | — | 55 | 44 | — | — | — | — | 1 |

where: B=butadiene; IP=isoprene; BA=butyl acrylate; S=styrene;

MMA=methyl methacylate; IA=itaconic acid; methacrylic acid; and AA=acrylic acid.

The binder to organic silver salt weight ratio is preferably in the range of 0.2 to 6, and the thickness of the recording layer is preferably in the range of 1 to 50 μm.

Thermal Solvents

The above mentioned binders or mixtures thereof may be used in conjunction with waxes or "heat solvents" also called "thermal solvents" or "thermosolvents" improving the reaction speed of the redox-reaction at elevated temperature. By the term "heat solvent" in this invention is meant a non-hydrolyzable organic material which is in a solid state in the recording layer at temperatures below 50° C., but becomes a plasticizer for the recording layer where thermally heated and/or a liquid solvent for at least one of the redox-reactants.

Toning Agents

In order to obtain a neutral black image tone in the higher densities and neutral grey in the lower densities, thermographic recording materials according to the present invention may contain one or more toning agents. The toning agents should be in thermal working relationship with the substantially light-insensitive organic silver salt and reducing agents during thermal processing. Any known toning agent from thermography or photothermography may be used. Suitable toning agents are the phthalimides and phthalazinones within the scope of the general formulae described in U.S. Pat. No. 4,082,901 and the toning agents described in U.S. Pat. No. 3,074,809, U.S. Pat. No. 3,446,648 and U.S. Pat. No. 3,844,797. Particularly useful toning agents are heterocyclic compounds of the benzoxazine dione or naphthoxazine dione type disclosed in GB-P 1,439,478, U.S. Pat. No. 3,951,660 and U.S. Pat. No. 5,599,647.

Polycarboxylic Acids and Anhydrides Thereof

According to a preferred embodiment of the present invention the substantially light-insensitive black and white monosheet thermographic recording material, the thermosensitive element further contains at least one polycarboxylic acid and/or anhydride thereof in a molar percentage of at least 15 with respect to the substantially light-insensitive organic silver salt and in thermal working relationship therewith. The polycarboxylic acid may be aliphatic (saturated as well as unsaturated aliphatic and also cycloaliphatic) as disclosed in U.S. Pat. No. 5,527,758 or an aromatic polycarboxylic acid, may be substituted and may be used in anhydride form or partially esterified on the condition that at least two free carboxylic acids remain or are available in the heat recording step.

Stabilizers and Antifoggants

In order to obtain improved shelf-life and reduced fogging, stabilizers and antifoggants may be incorporated into the thermographic recording materials of the present invention.

Surfactants and Dispersants

Surfactants and dispersants aid the dispersion of ingredients which are insoluble in the particular dispersion medium. The thermographic recording materials of the present invention may contain one or more surfactants, which may be anionic, non-ionic or cationic surfactants and/or one or more dispersants. Examples of suitable surfactants are:

Surfactant Nr. 1=HOSTAPAL™ B, a sodium trisalkylphenyl-polyethyleneglycol(EO 7-8)sulphate from Hoechst;

Surfactant Nr. 2=MERSOLAT™ H80, a sodium hexadecylsulfonate from Bayer;

Surfactant Nr. 3=ULTRAVON™ W, a sodium arylsulfonate from Ciba-Geigy;

Surfactant Nr. 4=TERGITOL™ 4, a sodium 1-(2'-ethylbutyl)-4-ethylhexylsulphate;

Surfactant Nr. 5=MARLON™ A-396, a sodium dodecylphenylsulfonate from Hüls;

Surfactant Nr. 6=HOSTAPAL™ W, a nonylphenylpolyethylene-glycol from Hoechst.

Suitable dispersants are natural polymeric substances, synthetic polymeric substances and finely divided powders, for example finely divided non-metallic inorganic powders such as silica.

Other Ingredients

In addition to the ingredients the thermographic recording material may contain other additives such as free fatty acids, antistatic agents, e.g. non-ionic antistatic agents including a fluorocarbon group e.g. $F_3C(CF_2)_6CONH(CH_2CH_2O)$—H, silicone oil, ultraviolet light absorbing compounds, white light reflecting and/or ultraviolet radiation reflecting pigments, silica, and/or optical brightening agents.

Support

The support for the thermographic recording material according to the present invention may be transparent, translucent or opaque and is preferably a thin flexible carrier made e.g. from paper, polyethylene coated paper or transparent resin film, e.g made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated heat-sensitive recording layer. The support may be made of an opacified resin composition.

Protective Layer

In a preferred embodiment of the present invention a protective layer is provided for the thermosensitive element. In general this protects the thermosensitive element from atmospheric humidity and from surface damage by scratching etc. and prevents direct con-act of printheads or heat sources with the recording layers. Protective layers for thermosensitive elements which come into contact with and have to be transported past a heat source under pressure, have to exhibit resistance to local deformation and good slipping characteristics during transport past the heat source during heating.

A slipping layer, being the outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layer compositions are described, for example, in EP-A 138 483, EP-A 227 090, U.S. Pat. No. 4,567,113, U.S. Pat. No. 4,572,860, U.S. Pat. No. 4,717,711, EP-A 311 841, U.S. Pat. No. 5,587,350, U.S. Pat. No. 5,536,696, U.S. Pat. No. 5,547,914, WO 95/12495, EP-A 775 592 and EP-A 775 595.

Coating Techniques

The coating of any layer of the thermographic recording materials of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A. Coating may proceed from aqueous or solvent media with overcoating of dried, partially dried or undried layers.

Thermographic Printing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat. To avoid direct contact of the thermal printing heads with a recording layer not provided with an outermost protective layer, the image-wise heating of the recording layer with the thermal printing heads may proceed through a contacting but removable resin sheet or web wherefrom during the heating no transfer of recording saterial can take place.

The image signals for modulating the laser beam or current in the micro-resistors of a thermal printhead are obtained directly or from an intermediary storage means, optionally linked to a digital image work station wherein the image information can be processed to satisfy particular needs. Activation of the heating elements can be power-modulated or pulse-length modulated at constant power. EP-A 654 355 describes a method for making an image by image-wise heating by means of a thermal head having energizable heating elements, wherein the activation of the heating elements is executed duty cycled pulsewise. When used in thermographic recording operating with thermal printheads the thermographic recording materials are not suitable for reproducing images with fairly large number of grey levels as is required for continuous tone reproduction. EP-A 622 217 discloses a method for making an image using a direct thermal imaging element producing improvements in continuous tone reproduction. Image-wise heating of the thermographic recording material can also be carried out using an electrically resistive ribbon incorporated into the material. Image- or pattern-wise heating of the thermographic recording material may also proceed by means of pixel-wise modulated ultra-sound, using e.g. an ultrasonic pixel printer as described e.g. in U.S. Pat. No. 4,908,631.

Industrial Application

Thermographic recording materials according to the present invention may be used for both the production of transparencies, for example in the medical diagnostic field in which black-imaged transparencies are widely used in inspection techniques operating with a light box, and reflection type prints, for example in the hard copy field. For such applications the support will be transparent or opaque, i.e. having a white light reflecting aspect. Should a transparent base be used, the base may be colourless or coloured, e.g. with a blue colour for medical diagnostic applications.

The following examples and comparative examples illustrate the present invention. The percentages and ratios used in the examples are by weight unless otherwise indicated. The following ingredients were used in the therosensitive element in addition to those mentioned above:

AgB=silver behenate;

K7598=KOEPF™ Type 7598, a calcium-free gelatin;

B79=BUTVAR™ B79 from MONSANTO;

CR01=ethyl 3,4-dihydroxybenzoate, a reducing agent according to the teaching of U.S. Pat. No. 5,582,953;

S01=adipic acid;

S02=tetrachlorophthalic anhydride

S03=benzotriazole

T01=benzo[e][1,3]oxazine-2,4-dione;

02=7-(ethylcarbonato)benzo[e][1,3]oxazine-2,4-dione;

Oil=Baysilon™ MA, a silicone oil from BAYER AG.

COMPARATIVE EXAMPLE 1 and INVENTION EXAMPLES 1 & 2

Preparation of aqueous dispersion of silver behenate 9000 g of silver behenate were added with stirring to 9000 g of a 10% aqueous solution of Surfactant Nr 5 diluted with 20,146 g of deionized water and the mixture stirred for 30 minutes with a KOTTHOFF™ stirrer. The resulting dispersion was then passed four times through a MICROFLUIDICS™ high pressure homogenizer at a pressure of 400 bar to obtain a finely divided aqueous silver behenate dispersion.

Preparation of a Tone Modifier Dispersion

The tone modifier dispersion was prepared by first dissolving 8.8 g of K7598 in 71.4 g of deionized water by first adding the gelatin, then allowing the gelatin to swell for 30 minutes and finally heating to 50° C. 20 g of T01 was added with ULTRA-TURRAX™ stirring to this gelatin solution at 50° C., and the stirring continued for a further 5 minutes. Finally the resulting dispersion was pumped through a DYNOMILL™ (a horizontal bead mill from BACHOFEN) for 2 hours to produce the final tone modifier dispersion containing: 20% of T01 and 8.8% of gelatin.

Preparation of the Silver Behenate Emulsion Layers

The coating dispersions for the thermographic recording materials of COMPARATIVE EXAMPLE 1 and INVENTION EXAMPLES 1 & 2 were prepared by first dissolving 1.927 g of K7598 in deionized water at 38° C. (for the quantity of water see table 1), then adding with stirring to the warm K7598 solution: first 19.0 g of the silver behenate dispersion, then 5.9 g of a 30% dispersion of polymer latex nr. 1 and 5.68 g of the tone modifier dispersion as flakes followed by 5 minutes stirring, then the reducing agent (s) (for quantities and types see table 1) dissolved in 1.71 g of ethanol and finally 1.310 g of a 3.7% by weight solution of formaldehyde to produce the corresponding coating dispersions.

TABLE 1

| | Quantity of water [g] | reducing agent(s) number | reducing agent(s) weight [g] |
|---|---|---|---|
| Comparative example number | | | |
| 1 | 23.55 | CR01 | 0.92 |
| Invention example number | | | |
| 1 | 23.37 | R02 | 1.10 |
| 2 | 23.79 | R03 | 0.68 |

The resulting emulsions were then doctor blade-coated to a wet thickness of 60 $\mu$m at a blade setting of 100 $\mu$m onto a 175 $\mu$m thick subbed polyethylene terephthalate support and dried for 10 minutes at 50° C., producing the thermosensitive elements of the thermographic recording materials of COMPARATIVE EXAMPLES 1 and INVENTION EXAMPLES 1 & 2 with the compositions given in table 2.

TABLE 2

| | AgB [g/m$^2$] | Surfactant Nr 5 [g/m$^2$] | reducing agent nr. | reducing agent [g/m$^2$] | K7598 [g/m$^2$] | polymer latex nr 1 [g/m$^2$] | HCHO [g/m$^2$] | T02 [g/m$^2$] |
|---|---|---|---|---|---|---|---|---|
| Comparative Example Number | | | | | | | | |
| 1 | 4.76 | 0.48 | CR01 | 0.97 | 2.59 | 1.88 | 0.05 | 1.20 |
| Invention Example Nr | | | | | | | | |
| 1 | 4.68 | 0.47 | R02 | 1.15 | 2.55 | 1.85 | 0.05 | 1.18 |
| 2 | 4.65 | 0.47 | R03 | 0.70 | 2.53 | 1.84 | 0.05 | 1.17 |

Thermographic Printing

During printing of the recording materials of COMPARATIVE EXAMPLE 1 and INVENTION EXAMPLES 1 & 2 the print head was separated from the imaging layer by a thin intermediate material contacted with a slipping layer of a separable 5 $\mu$m thick polyethylene terephthalate ribbon coated successively with a subbing layer, heat-resistant layer and the slipping layer (anti-friction layer) giving a ribbon with a total thickness of 6 $\mu$m.

The printer was equipped with a thin film thermal head with a resolution of 300 dpi and was operated with a line time of 19 ms (the line time being the time needed for printing one line). During this line time the print head received constant power. The average printing power, being the total amount of electrical input energy during one line time divided by the line time and by the surface area of the heat-generating resistors was 1.6 mJ/dot being sufficient to obtain maximum optical density in each of the thermographic recording materials of COMPARATIVE EXAMPLES 1 and INVENTION EXAMPLES 1 & 2.

Image Evaluation

The colour neutrality of the optical density (D) of these images was evaluated by measuring the optical densities through blue, green and red filters using a MacBeth™ TR924 densitometer. The lowest, next highest and highest optical densities were assigned to $D_1$, $D_2$ and $D_3$ respectively and were used to obtain a numerical colour value (NCV) by substituting the corresponding values in the following equation:

$$NCV = \frac{D_1 \times D_2}{(D_3)^2}$$

The larger the NCV value the better the colour neutrality of the image obtained. Maximal colour neutrality corresponds to a NCV value of 1. NCV values were determined at optical densities (D) with a visual filter of 1, 2 and 3 for the fresh materials, the same materials after being heated at 35° C. in a relative humidity of 80% for 3 days and the same materials after being exposed in the light box described below at 30° C. in a relative himidity of 85% for 3 days for the materials of COMPARATIVE EXAMPLE 1 and INVENTION EXAMPLES 1 & 2. The NCV-values obtained are summarized in table 3 below.

TABLE 3

| | reducing agent | numerical colour value, NCV: fresh print D = 1 | fresh print D = 2 | fresh print D = 3 | print after 3d at 35° C./80% RH D = 1 | print after 3d at 35° C./80% RH D = 2 | print after 3d at 35° C./80% RH D = 3 | print after 3d light box at 30° C./85% RH D = 1 | print after 3d light box at 30° C./85% RH D = 2 | print after 3d light box at 30° C./85% RH D = 3 |
|---|---|---|---|---|---|---|---|---|---|---|
| Comparative Example Nr. | | | | | | | | | | |
| 1 | CR01 | 0.65 | 0.65 | 0.73 | 0.82 | 0.86 | 0.83 | 0.72 | 0.73 | 0.76 |

TABLE 3-continued

| | reducing agent | numerical colour value, NCV | | | | | | | | |
|---|---|---|---|---|---|---|---|---|---|---|
| | | fresh print | | | print after 3d at 35° C./80% RH | | | print after 3d light box at 30° C./85% RH | | |
| | | D = 1 | D = 2 | D = 3 | D = 1 | D = 2 | D = 3 | D = 1 | D = 2 | D = 3 |
| Invention Example Nr. | | | | | | | | | | |
| 1 | R02 | 0.69 | 0.73 | 0.81 | 0.75 | 0.80 | 0.85 | 0.70 | 0.74 | 0.83 |
| 2 | R03 | 0.72 | 0.73 | 0.78 | 0.82 | 0.84 | 0.84 | 0.77 | 0.75 | 0.79 |

The NCV-values in table 3 enable materials with different reducing agents to be compared on the basis of their colour neutrality, the dependence of their colour neutrality upon image optical density. The NCV values for fresh prints and prints of the thermographic recording materials of INVENTION EXAMPLES 1 & 2 exposed in the light box for 3 days at 30° C. in 85% relative humidity are clearly superior to those of the thermographic recording material of COMPARATIVE EXAMPLE 1 with a reducing agent according to the teaching of U.S. Pat. No. 5,582,953 and those for prints stored in the dark for 3 days at 35° C. in 80% relative humidity are comparable therewith. It is therefore evident that prints made with the thermographic recording materials using the novel reducing agents of the present invention exhibit superior colour neutrality to prior art materials.

The maximum and minimum densities of the prints measured through a visible or blue filter with a MACBETH™ TR924 densitometer in the grey scale step corresponding to data levels of 64 and 0 respectively are given in table 4.

Archivability Test

The archivability of prints made with the thermographic recording materials of COMPARATIVE EXAMPLE 1 and INVENTION EXAMPLES 1 & 2 was evaluated on the basis of the observed changes in NCV-values and minimum density, $\Delta D_{min}$, upon heating the prints at 35° C. in a relative humidity of 80% for 3 days in the dark. The results of these tests are als given in table 4.

Light Box Test

The stability of the image background of the prints made with the thermographic recording materials of COMPARATIVE EXAMPLE 1 and INVENTION EXAMPLES 1 & 2 was evaluated on the basis of the change in NCV-values and minimum (background) density and maximum density measured through a blue filter using a MacBeth™ TR924 densitometer upon exposure on top of the white PVC window of a specially constructed light-box placed for 3 days in a VOTSCH conditioning cupboard set at 30° C. and a relative humidity of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 PLANILUX™ TLD 36W/54 fluorescent lamps 27 mm in diameter mounted length-wise equidistantly from the two sides, with the lamps positioned equidistantly to one another and the sides over the whole width of the light-box and with the tops of the fluorescent tubes 30 mm below the bottom of the white PVC plate and 35 mm below the materials being tested. The results are summarized in table 4.

TABLE 4

| | reducing agent | fresh print $D_{max}/D_{min}$ (vis) | fresh print $D_{max}/D_{min}$ (blue) | Archivability $\Delta D_{min}$ (blue) after (3d at 35° C./80% RH) | Light Box $\Delta D_{min}$ (blue) after (3d 30° C./85% RH) |
|---|---|---|---|---|---|
| Comparative example number | | | | | |
| 1 | CR01 | 4.65/0.10 | 4.42/0.13 | 0.12 | 0.15 |
| Invention example nr | | | | | |
| 1 | R02 | 4.44/0.09 | 4.18/0.12 | 0.01 | 0.11 |
| 2 | R03 | 4.71/0.09 | 4.36/0.12 | 0.04 | 0.12 |

The results of the thermographic evaluation of the thermographic recording materials of INVENTION EXAMPLES 1 & 2 incorporating novel reducing agents according to the present invention, clearly demonstrate the improved archivability and light box stability (reduced $\Delta D_{min}$ values) of their prints compared with prints made with the thermographic recording material of COMPARATIVE EXAMPLE 1 with a reducing agent according to the teaching of U.S. Pat. No. 5,582,953.

COMPARATIVE EXAMPLE 2 & INVENTION EXAMPLES 3 to 6

Preparation of a Silver Behenate Dispersion 2.5 g of a 30% solution of B79 in 2-butanone, 10 g of silver behenate and 37.5 g of 2-butanone were mixed for 72 hours in a hall mill and then 30.83 g of a 30% solution of B79 and 7.67 g of 2-butanone were added to produce a 2-butanone dispersion containing 11.3% of silver behenate and 11.3% by weight of B79.

Preparation of the Thermosensitive Element

The subbed 175 μm thick polyethylene terephthalate support was doctor blade-coated with a composition containing 2-butanone as solvent/dispersing medium so as to obtain thereon, after drying for 1 hour at 50° C., a thermosensitive element with the compositions summarized in tables 5 and 6 below for COMPARATIVE EXAMPLE 2 and INVENTION EXAMPLES 3 to 6 respectively:

TABLE 5

| Comparative example number | AgB [g/m²] | B79 [g/m²] | Oil [g/m²] | T01 [g/m²] | T02 [g/m²] | CR01 [g/m²] | S01 [g/m²] | S02 [g/m²] | S03 [g/m²] |
|---|---|---|---|---|---|---|---|---|---|
| 2 | 4.91 | 19.62 | 0.045 | 0.27 | 0.14 | 0.989 | 0.35 | 0.16 | 0.13 |

TABLE 6

| Invention Example nr | AgB [g/m²] | B79 [g/m²] | Oil [g/m²] | T01 [g/m²] | T02 [g/m²] | reducing agent nr. | reducing agent [g/m²] | S01 [g/m²] | S02 [g/m²] | S03 [g/m²] |
|---|---|---|---|---|---|---|---|---|---|---|
| 3 | 4.91 | 19.62 | 0.045 | 0.27 | 0.14 | R01 | 1.436 | 0.35 | 0.16 | 0.13 |
| 4 | 4.91 | 19.62 | 0.045 | 0.27 | 0.14 | R03 | 0.728 | 0.35 | 0.16 | 0.13 |
| 5 | 4.91 | 14.69 | 0.044 | 0.27 | 0.14 | R01 | 1.436 | 0.30 | 0.15 | 0.13 |
| 6 | 4.91 | 19.57 | 0.044 | 0.27 | 0.14 | R01 | 1.436 | 0.30 | 0.15 | 0.13 |

Thermographic Evaluation

The thermographic recording materials of COMPARATIVE EXAMPLE 2 and INVENTION EXAMPLES 3 to 6 were evaluated as described above for COMPARATIVE EXAMPLE 1 and INVENTION EXAMPLES 1 & 2 except that the archivability tests were carried out for 3 days at 57° C. in a relative humidity of 34% instead of 3 days at 35° C. in a relative humidity of 80%. The NCV-values for the thermographic recording materials of COMPARATIVE EXAMPLE 2 and INVENTION EXAMPLES 3 to 6 for fresh prints and prints exposed in the light box for 3 days at 30° C. in a relative humidity of 85% are given in table 7 below.

The NCV-values in table 7 enable materials with different reducing agents to be compared on the basis of their colour neutrality, the dependence of their colour neutrality upon image optical density, the higher the values the better the colour neutrality. The NCV values for fresh prints of the thermographic recording materials of INVENTION EXAMPLES 3 to 6 are comparable to those of the thermographic recording material of COMPARATIVE EXAMPLE 2. However, when the prints made with these thermographic recording materials are exposed in the light box for 3 days at 30° C. in 85% relative humidity, the deterioration in colour neutrality of the thermographic recording material of COMPARATIVE EXAMPLE 2 with a reducing agent according to the teaching of U.S. Pat. No. 5,582,953 is greater than that observed for the thermographic recording material of INVENTION EXAMPLE 4 and substantially greater than that observed for the thermographic recording materials of INVENTION; EXAMPLES 3, 5 and 6 for which there is little discernible change in colour neutrality. The most critical NCV-value in terms of the visual perception of a viewer is that at a density of 1.0. The change in NCV-value, ΔNCV, at D=1 for prints made with the thermographic recording materials of INVENTION EXAMPLES 3 to 6 is significantly lower (−0.08 to +0.02) than that for the thermographic recording material of COMPARATIVE EXAMPLE 2 (−0.10).

The $D_{max}$, $\Delta D_{max}$, $D_{min}$ and $\Delta D_{min}$ results for the archivability and light box tests for COMPARATIVE EXAMPLE 2 and INVENTION EXAMPLES 3 to 6 a re summarized in table 8 below.

TABLE 7

| | reducing agent | NCV-values for fresh print D = 1 | D = 2 | D = 3 | ΔNCV-values for print after 3d light box at 30° C./85% RH D = 1 | D = 2 | D = 3 |
|---|---|---|---|---|---|---|---|
| Comparative Example Nr. | | | | | | | |
| 2 | CR01 | 0.91 | 0.95 | 0.97 | −0.10 | −0.04 | −0.03 |
| Invention Example Nr. | | | | | | | |
| 3 | R01 | 0.90 | 0.95 | | 0.00 | +0.01 | |
| 4 | R03 | 0.89 | 0.96 | | −0.08 | −0.02 | |
| 5 | R01 | 0.84 | 0.91 | 0.97 | +0.02 | +0.06 | 0.00 |
| 6 | R01 | 0.90 | 0.95 | 0.97 | −0.01 | 0.00 | −0.03 |

TABLE 8

| | reducing agent | fresh print $D_{max}/D_{min}$ (vis) | fresh print $D_{max}/D_{min}$ (blue) | Archivability $D_{max}/D_{min}$ (blue) after 3d at 57° C./34% RH | Light Box $D_{max}/D_{min}$ (blue) after 3d at 30° C./85% RH |
|---|---|---|---|---|---|
| Comparative Example number | | | | | |
| 2 | CR01 | 3.72/0.07 | 3.38/0.09 | 0.50/0.00 | 0.15/0.02 |
| Invention Example number | | | | | |
| 3 | R01 | 2.87/0.07 | 2.53/0.08 | 0.07/0.01 | 0.04/0.01 |
| 4 | R03 | 2.83/0.07 | 2.59/0.08 | 0.14/0.00 | 0.10/0.03 |
| 5 | R01 | 3.31/0.07 | 3.06/0.07 | −0.07/0.00 | 0.08/0.01 |
| 6 | R01 | 3.09/0.07 | 2.88/0.08 | 0.05/0.00 | 0.01/0.01 |

The results of the thermographic evaluation of the thermographic recording materials of INVENTION EXAMPLES 3 to 6 incorporating novel reducing agents according to the present invention, clearly demonstrate the improved archivability and light box stability (reduced $\Delta D_{max}$ and $\Delta D_{min}$ values) of their prints compared with prints made with the thermographic recording material of COMPARATIVE EXAMPLE 2 with a reducing agent according to the teaching of U.S. Pat. No. 5,582,953.

However, these values do not do justice to the substantial improvement in light stability over the whole sensitometric range realized with the prints made with the thermographic recording materials of INVENTION EXAMPLES 3 to 6 compared with that with the prints made with the thermographic recording material of COMPARATIVE EXAMPLE 2. Table 9, therefore gives the density values and density changes for different pulse energies over the whole sensitometric range for prints made with the thermographic recording materials of COMPARATIVE EXAMPLE 2 and INVENTION EXAMPLES 3 to 6.

It is evident from table 9 that the light stability over the whole sensitometric range of prints made with the thermographic recording materials of INVENTION EXAMPLES 3 to 6 is substantially improved over that obtained with prints made with the thermographic recording material of COMPARATIVE EXAMPLE 2 with a reducing agent according to the teaching of U.S. Pat. No. 5,582,953.

Having described in detail preferred embodiments of the current invention, it will now be apparent to those skilled in the art that numerous modifications can be made therein without departing from the scope of the invention as defined in the following claims.

What is claimed is:

1. A substantially light-insensitive black and white monosheet thermographic recording material comprising a support and a thermosensitive element, said thermosensitive element comprising a substantially light-insensitive organic silver salt, a 1, 2-dihydroxyphenyl-compound in thermal working relationship therewith and a binder, wherein said 1, 2-dihydroxyphenyl-compound is represented by formula (I):

TABLE 9

| | comparative example 2 | | invention example 3 | | invention example 4 | | invention example 5 | | invention example 6 | |
|---|---|---|---|---|---|---|---|---|---|---|
| energy/dot [μJ] | fresh print Dvis | light box ΔDvis | fresh print Dvis | light box ΔDvis | fresh print Dvis | light box ΔDvis | fresh print Dvis | light box ΔDvis | fresh print Dvis | light box ΔDvis |
| 7.5 | 0.07 | 0.00 | 0.07 | 0.00 | 0.07 | 0.02 | 0.07 | 0.00 | 0.07 | 0.00 |
| 15 | 0.07 | 0.00 | 0.07 | 0.00 | 0.07 | 0.00 | 0.07 | 0.00 | 0.07 | 0.00 |
| 27.5 | 0.07 | 0.00 | 0.07 | 0.00 | 0.07 | 0.00 | 0.07 | 0.00 | 0.07 | 0.00 |
| 35 | 0.07 | 0.00 | 0.07 | 0.00 | 0.07 | 0.00 | 0.07 | 0.00 | 0.07 | 0.00 |
| 47.5 | 0.08 | 0.00 | 0.07 | 0.00 | 0.07 | 0.01 | 0.07 | 0.00 | 0.07 | 0.00 |
| 55 | 0.09 | 0.00 | 0.07 | 0.00 | 0.08 | 0.01 | 0.07 | 0.00 | 0.07 | 0.01 |
| 67.5 | 0.17 | 0.03 | 0.09 | 0.00 | 0.12 | 0.01 | 0.10 | 0.00 | 0.10 | 0.00 |
| 75 | 0.28 | 0.07 | 0.13 | 0.00 | 0.19 | 0.01 | 0.16 | 0.00 | 0.16 | 0.00 |
| 87.5 | 0.52 | 0.12 | 0.27 | 0.00 | 0.36 | 0.01 | 0.34 | 0.00 | 0.31 | 0.01 |
| 95 | 0.74 | 0.18 | 0.40 | 0.00 | 0.52 | 0.01 | 0.53 | 0.01 | 0.50 | 0.00 |
| 107.5 | 1.12 | 0.21 | 0.66 | 0.00 | 0.79 | 0.02 | 0.82 | 0.04 | 0.79 | 0.02 |
| 115 | 1.50 | 0.21 | 0.89 | 0.02 | 1.07 | 0.02 | 1.15 | 0.02 | 1.13 | 0.00 |
| 127.5 | 2.13 | 0.29 | 1.39 | 0.04 | 1.53 | 0.03 | 1.79 | 0.05 | 1.63 | 0.06 |
| 135 | 2.64 | 0.25 | 1.80 | 0.05 | 1.95 | 0.03 | 2.19 | 0.09 | 2.06 | 0.09 |
| 147.5 | 3.24 | 0.21 | 2.38 | 0.07 | 2.35 | 0.07 | 2.88 | 0.04 | 2.57 | 0.10 |
| 155 | 3.66 | 0.19 | 2.41 | 0.04 | 2.77 | 0.04 | 3.20 | 0.07 | 3.02 | 0.10 |
| 157.5 | 3.67 | 0.12 | 2.86 | −0.08 | 2.80 | −0.01 | 3.14 | 0.12 | 3.07 | 0.11 |
| 160 | 3.72 | 0.21 | 2.87 | 0.00 | 2.83 | −0.01 | 3.31 | 0.02 | 3.09 | 0.11 |

(I)

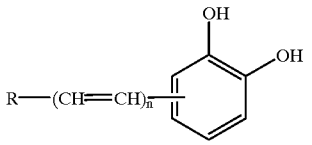

where R is —P(=O)$R^1R^2$, —$SO_xR^3$, —CN, —$NO_2$ or —$CR^4$=$NR^5$ when n is 0; R is —P(=O)$R^1R^2$, —$SO_xR^3$, —CN, —$NO_2$, —$CR^4$=$NR^5$ or —$COR^6$ when n is an integer; $R^1$ and $R^2$ are independently an alkyl, an aryl, an alkoxy, an aryloxy, a hydroxy or an amino group; $R^3$ is an alkyl, an aryl or an amino group; $R^4$ is an alkyl or an aryl group or hydrogen; $R^5$ is an alkyl, an aryl, a hydroxy, an alkoxy, an aryloxy, an acyl or an amino group; $R^6$ is an alkyl, an aryl, an alkoxy, an aryloxy, a hydroxy or an amino group or hydrogen; x is 1, 2, or 3; and the benzene ring of the 1, 2-dihydroxyphenyl-compound represented by the formula (I) may be further substituted with halogen atoms, aryl groups, alkyl groups, and the atoms necessary to form an annulated carbocyclic or heterocyclic ring.

2. Substantially light-insensitive black and white monosheet thermographic recording material according to claim 1, wherein said 1,2-dihydroxyphenyl-compound is represented by the following formula:

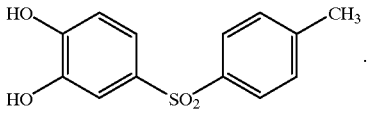

3. Substantially light-insensitive black and white monosheet thermographic recording material according to claim 1, wherein said 1,2-dihydroxyphenyl-compound is represented by the following formula:

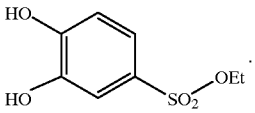

4. Substantially light-insensitive black and white monosheet thermographic recording material according to claim 1, wherein said 1,2-dihydroxyphenyl-compound is represented by the following formula:

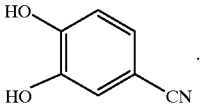

5. Substantially light-insensitive black and white monosheet thermographic recording material according to claim 1, wherein said thermosensitive element further contains at least one polycarboxylic acid and/or anhydride thereof in a molar percentage of at least 15 with respect to said substantially light-insensitive organic silver salt and in thermal working relationship therewith.

6. Substantially light-insensitive black and white monosheet thermographic recording material according to claim 1, wherein said thermosensitive element is provided with a protective layer.

7. Substantially light-insensitive black and white monosheet thermographic recording material according to claim 1, wherein said substantially light-insensitive organic silver salt is a silver salt of an organic carboxylic acid.

8. A substantially light-insensitive black and white monosheet thermographic recording material comprising a support and a themnosensitivc element, said thermosensitive element comprising a substantially light-insensitive organic silver salt, a 1, 2-dihydroxyphenyl-compound in thermal working relationship therewith and a binder, wherein said 1,2-dihydroxyphenyl-compound is selected from the group consisting of: aryl (3,4-dihydroxyphenyl) sulfinates, alkyl (3,4-dihydroxyphenyl) sulfinates, 3,4-dihydroxyphenyl-alkylsulfones, 3,4-dihydroxyphenyl-arylsulfones, aryl (3,4-dihydroxyphenyl) sulfonates, alkyl (3,4-dihydroxyphenyl) sulfonates and 3,4-dihydroxybenzonitrile compounds.

9. Substantially light-insensitive black and white monosheet thermographic recording material according to claim 8, wherein said 1,2-dihydroxyphenyl-compound is represented by the following formula:

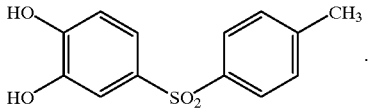

10. Substantially light-insensitive black and white monosheet thermographic recording material according to claim 8, wherein said 1,2-dihydroxyphenyl-compound is represented by the following formula:

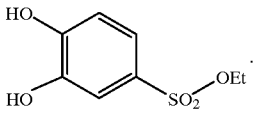

11. Substantially light-insensitive black and white monosheet thermographic recording material according to claim 8, wherein said 1,2-dihydroxyphenyl-compound is represented by the following formula:

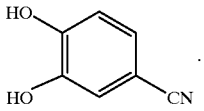

12. Substantially light-insensitive black and white monosheet thermographic recording material according to claim 8, wherein said thermosensitive element further contains at least one polycarboxylic acid and/or anhydride thereof in a molar percentage of at least 15 with respect to said substantially light-insensitive organic silver salt and in thermal working relationship therewith.

13. Substantially light-insensitive black and white monosheet thermographic recording material according to claim 8, wherein said thermosensitive element is provided with a protective layer.

14. Substantially light-insensitive black and white monosheet thermographic recording material according to claim 8, wherein said substantially light-insensitive organic silver salt is a silver salt of an organic carboxylic acid.

15. A process for producing a substantially light-insensitive black and white monosheet thermographic recording material, including a support and a thermosensitive element, said thermosensitive element comprising a substantially light-insensitive organic silver salt, a 1,2-dihydroxyphenyl-compound in thermal working relationship therewith and a binder, the process comprising preparing one or more aqueous coating compositions together containing said substantially light-insensitive organic silver salt, said 1,2-dihydroxyphenyl-compound and said binder; and applying said one or more aqueous coating compositions to the same side of said support thereby forming after drying said thermosensitive element, wherein said 1,2-dihydroxyphenyl-compound is represented by formula (I):

(I)

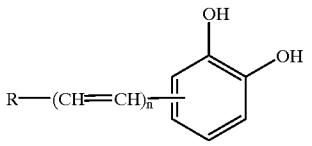

where R is $—P(=O)R^1R^2$, $—SO_xR^3$, —CN, $—NO_2$ or $—CR^4=NR^5$ when n is 0; R is $—P(=O)R^1R^2$, $—SO_xR^3$, —CN, $—NO_2$, $—CR^4=NR^5$ or $—COR^6$ when n is an integer; $R^1$ and $R^2$ are independently an alkyl, an aryl, an alkoxy, an aryloxy, a hydroxy or an amino group; $R^3$ is an alkyl, an aryl or an amino group; $R^4$ is an alkyl or an aryl group or hydrogen; $R^5$ is an alkyl, an aryl, a hydroxy, an alkoxy, an aryloxy, an acyl or an amino group; $R^6$ is an alkyl, an aryl, an alkoxy, an aryloxy, a hydroxy or an amino group or hydrogen; x is 1, 2, or 3; and the benzene ring of the 1,2-dihydroxyphenyl-compound represented by the formula (I) may be further substituted with halogen atoms, aryl groups, alkyl groups, and the atoms necessary to form an annulated carbocyclic or heterocyclic ring.

16. A process for producing a substantially light-insensitive black and white monosheet thermographic recording material, including a support and a thermosensitive element, said thermosensitive element comprising a substantially light-insensitive organic silver salt, a 1,2-dihydroxyphenyl-compound in thermal working relationship therewith and a binder, the process comprising preparing one or more aqueous coating compositions together containing said substantially light-insensitive organic silver salt, said 1, 2-dihydroxyphenyl-compound and said binder; and applying said one or more aqueous coating compositions to the same side of said support thereby forming after drying said thermosensitive element, wherein said 1,2-dihydroxyphenyl-compound is selected from the group consisting of: aryl (3,4-dihydroxyphenyl) sulfinates, alkyl (3,4-dihydroxyphenyl) sulfinates, 3,4-dihydroxyphenyl-alkylsulfones, 3,4-dihydroxyphenyl-arylsulfones, aryl (3,4-dihydroxyphenyl) sulfonates, alkyl (3,4-dihydroxyphenyl) sulfonates and 3,4-dihydroxybenzonitrile compounds.

* * * * *